US005945955A

United States Patent [19]

Glover et al.

[11] Patent Number: 5,945,955

[45] Date of Patent: Aug. 31, 1999

[54] HEATING SYSTEM FOR MICROWAVE ANTENNA REFLECTOR AND METHOD FOR MAKING THE SAME

[75] Inventors: Kelly R. Glover, Elm City; Ronald L. Boster, Smithfield, both of N.C.

[73] Assignee: Channel Master LLC, Smithfield, N.C.

[21] Appl. No.: 08/724,946

[22] Filed: Sep. 20, 1996

[51] Int. Cl.[6] ..... H01Q 1/02; H01Q 15/16

[52] U.S. Cl. ..... 343/704; 343/912

[58] Field of Search ..... 343/704, 840, 343/912; H01Q 1/02, 15/16

[56] References Cited

U.S. PATENT DOCUMENTS

| | | | |
|---|---|---|---|
| 4,030,953 | 6/1977 | Rutschow et al. | 343/912 |
| 4,191,604 | 3/1980 | MacTurk | 343/912 |
| 4,647,329 | 3/1987 | Oono et al. | 343/912 |
| 5,162,810 | 11/1992 | Onisawa et al. | 343/912 |
| 5,178,709 | 1/1993 | Shimodaira et al. | 343/912 |

FOREIGN PATENT DOCUMENTS

| | | | |
|---|---|---|---|
| 2426343 | 1/1980 | France | 343/704 |
| 57-207402 | 12/1982 | Japan | 343/704 |

*Primary Examiner*—Michael C. Wimer
*Attorney, Agent, or Firm*—Darby & Darby

[57] ABSTRACT

A parabolic reflective antenna having a front concave surface and a rear convex surface. The reflective antenna including a heating assembly for preventing and removing ice and snow during cold weather. The heating assembly includes first and second woven supporting structures. A heating element is supported between the first and second supporting structures, the first and second woven supporting structures being interposed between the front and rear surfaces of the antenna. Heat generated from the heating element emanates to the front concave surface of the reflective antenna.

23 Claims, 5 Drawing Sheets

FIG. 3
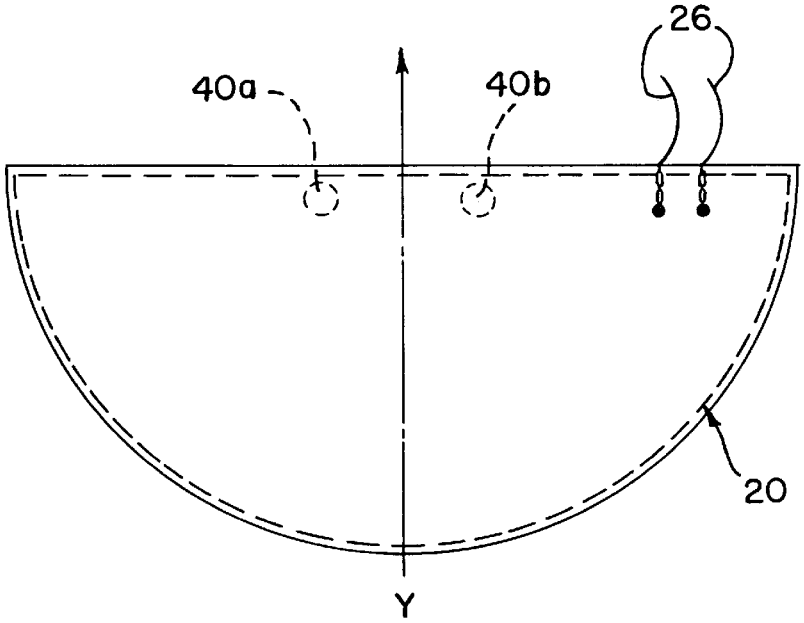
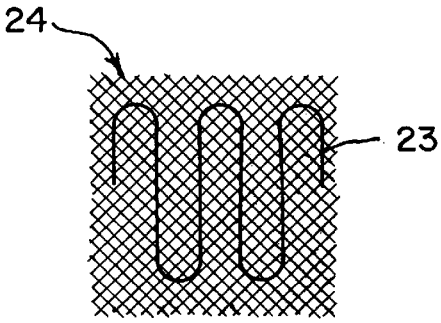
FIG. 4
FIG. 4a
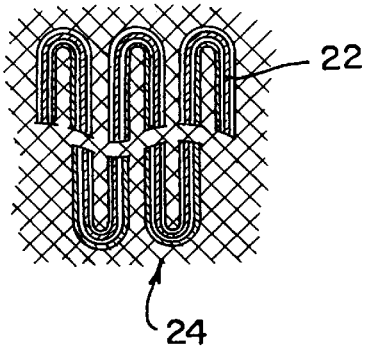
FIG. 5
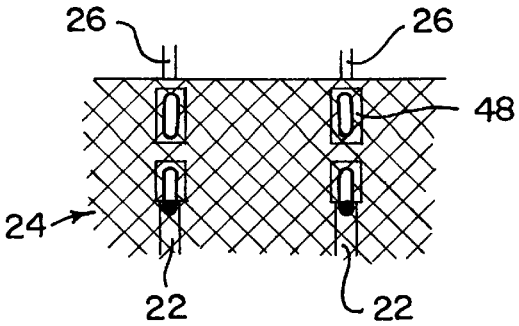

HEATING SYSTEM FOR MICROWAVE ANTENNA REFLECTOR AND METHOD FOR MAKING THE SAME

This invention relates to a heating system for a solid microwave antenna used for transmitting and receiving electromagnetic signals via satellite and, more particularly, to a electric heating element molded into the reflector portion of a microwave antenna configuration to prevent signal degradation due to ice and/or snow on the reflector, and a method for making the same.

BACKGROUND OF THE INVENTION

The typical microwave reflector comprises a large metal or fiberglass parabolic surface which may vary in size from several inches to 15 feet or greater in diameter. The reflector typically rests at an angle with respect to the horizontal plane. As a result of this tilt angle, the bottom half of the reflector tends to collect snow, ice or other forms of precipitation, all of which tend to degrade the performance of the reflector.

It is known to attach heating devices to parabolic microwave reflectors in an attempt to remove any ice or snow from the reflector surface. Such heating devices must be suitable for attachment to the curved surface of the parabolic reflector, and must be suitable for heating the relatively large surface of the reflector. Conventional heating methods comprise, for example, using a plurality of heating pad assemblies attached directly to the rear surface of the reflector. Such heating pad assemblies typically comprise a pair of silicone rubber pads between which a heating wire is traversed back and forth to effect heating over substantially the entire area of the pads. A pair of leads extending from the heating pad assembly is connected to a common power source together with leads from several other such heating pad assemblies, there being as many as a dozen or more such heating pad assemblies bonded to the back surface of a microwave reflector.

Employing another heating method, Canadian Patent No. 1,109,913 to Falsetti discloses securing a metal tube, which is heated by a sheathed heating wire, to the metal surface of the microwave reflector. In Falsetti, the microwave reflector is heated by direct metal-to-metal heat conduction. Other methods used to prevent ice or snow buildup on the antenna reflective surface include: (1) using heat tape or other conductive system which is bonded directly to the back side of the antenna, the heat tape having foam insulation applied thereover to reduce heat loss; (2) using radiation systems consisting of a cover of either molded plastic, sewn fabric or plastic which is mechanically attached to the back of the antenna; and (3) using convection systems employing a cover, blower and heater which together form a plenum when attached to the back side of the antenna.

Each of these heating systems entails attaching the heating source to the back side of the antenna. This causes the heating systems to interfere with the antenna support structures located on the back side of the antennas. Another disadvantage with presently available heating systems is that heat loss is very high, even with insulation on the back side and with controllers to activate the heaters only during snow and ice conditions by sensing temperature and precipitation. This results in high operating costs.

Therefore, the object of the present invention is to provide a heating system, and a process for manufacturing the same, in which snow and ice are effectively kept from forming on the reflective surface of the antenna.

It is also an object of the invention to provide a heating system which is not susceptible to the high levels of heat loss, thereby making the system substantially less expensive to operate.

Yet another object of the present invention is to eliminate the requirement of attaching a heating system to the back side of a reflective antenna.

SUMMARY OF THE INVENTION

The present invention is directed to a reflective antenna having a heating device for heating the reflector portion of a parabolic antenna. The reflector portion is heated to prevent ice and snow from accumulating thereon. A method for making the same is also disclosed.

The parabolic shaped reflective antenna includes a front concave surface and a rear convex surface. A heating element is supported between layers of a woven structure. The woven structure is interposed between the front and rear surfaces of the reflective antenna. In particular, the woven structure is adjacent to the front surface of the reflective antenna. Heat generated from the heating element emanates to at least a portion of the front concave surface of the reflective antenna The method for making the same includes the steps of, first, placing an electrical heating element in a layer of woven material to form a layer of woven material having a retained electrical heating element. Next, the layer of woven material and retained electrical heating element is embedded in a curable compound. The curable compound is then cured to form the reflective antenna configuration having the integrally molded heating element. Specifically, the compound is compression molded whereby the woven structure maintains the integrity of the electrical heating element during the molding process.

BRIEF DESCRIPTION OF THE DRAWINGS

The foregoing and other features of the present invention will be more readily apparent from the following detailed description and drawings of an illustrative embodiment of the invention in which:

FIG. 3 is an elevational view of the heating element, showing attachment points for locating the heating element in the reflector;

FIG. 4 illustrates the preferred method for supporting the heater element within the antenna during the molding process;

FIG. 4*a* illustrates an alternative method for supporting the heater element within the antenna during the molding process;

FIGS. 5 and 6 illustrate how the leads are secured to the reflector;

DESCRIPTION OF AN ILLUSTRATIVE EXEMPLARY EMBODIMENT

Figure 1:
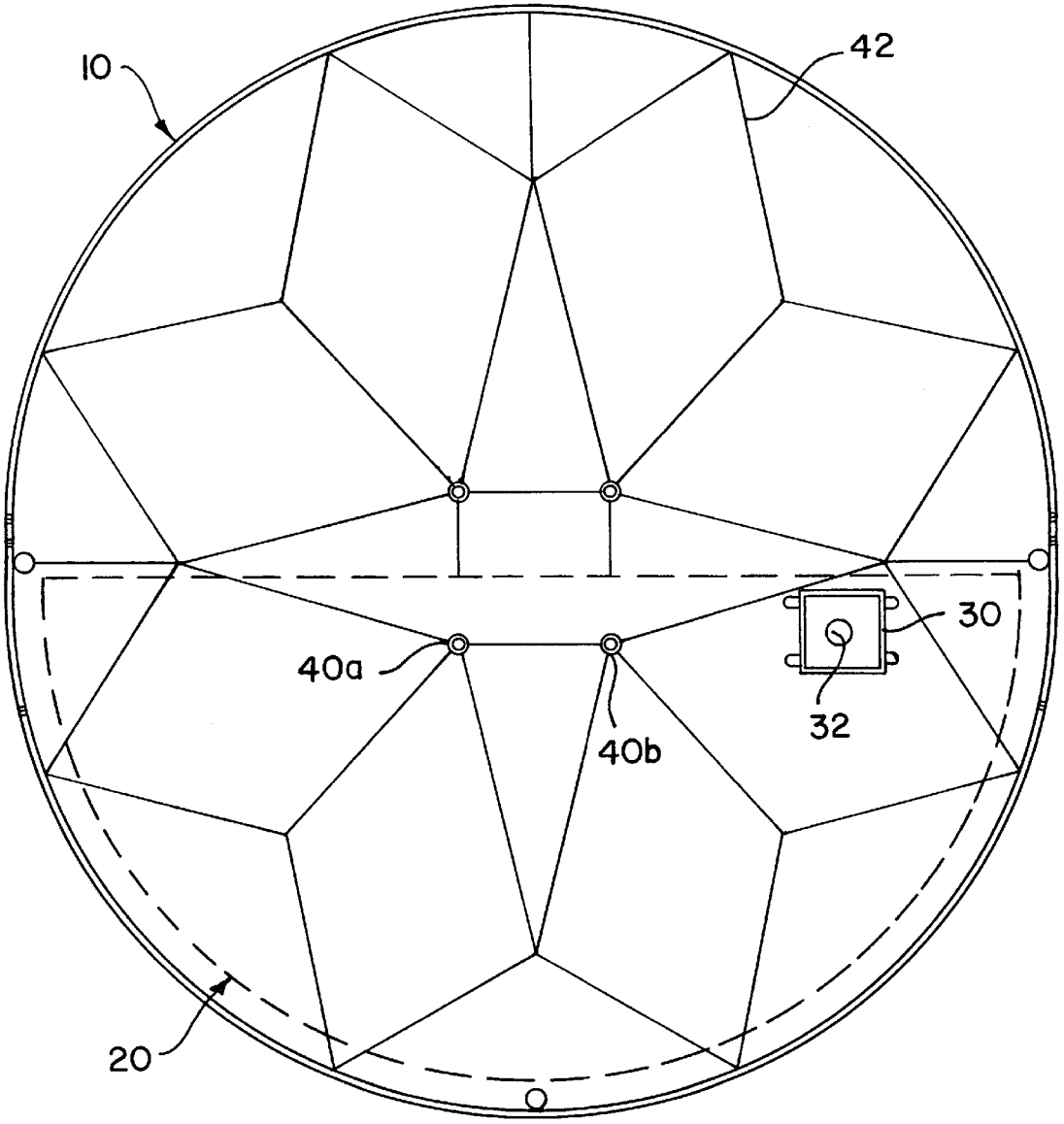
FIG. 1 is a rear elevational view of the reflector showing the location of the heating element according to the invention.

FIG. 1 illustrates, by way of example, a parabolic antenna 10 as shown from the rear. The antenna 10 is typically mounted at a tilt angle preferably between 0 and 50 degrees relative to a vertical reference plane. With such angles, the lower half of the concave portion of antenna 10 tends to retain ice and snow thereon which, if not removed, would result in a degraded signal. As shown outlined by the dotted lines in FIG. 1, a heating element 20 is provided to remove any snow or ice which accumulates on the reflecting surface of antenna 10. The heating element 20, discussed in greater detail below with reference to FIG. 4, is preferably an resistive heating element, which is supported in a woven structure (e.g., an open fiber glass weave). According to the invention, the woven supported heating element 20 is integrally molded within the antenna structure 10. The heating element 20 is preferably located on the cavity side of the mold, preferably between about 0.005" to 0.025" from the concave parabolic reflecting surface of antenna 10. Attached to heating element 20 are two lead wires 26 configured to electrically connect heating element 20 to a power supply (not shown).

Also shown in FIG. 1 is a junction box 30 which is preferably mounted directly to the back side of antenna 10 using a suitable structural adhesive, for example, a two part structural epoxy. The junction box 30 contains the electrical connections between heating element 20 and the power supply. As shown, junction box 30 contains a centrally located hole 32, which, in the preferred embodiment is approximately 1.62" in diameter. This central hole 32 is for receiving lead wires 26 extending from heating element 20. The centrally located hole 32 is preferably kept as large as practicable because lead wires 26 may not always be in the same location at the completion of the molding process.

Figure 2:
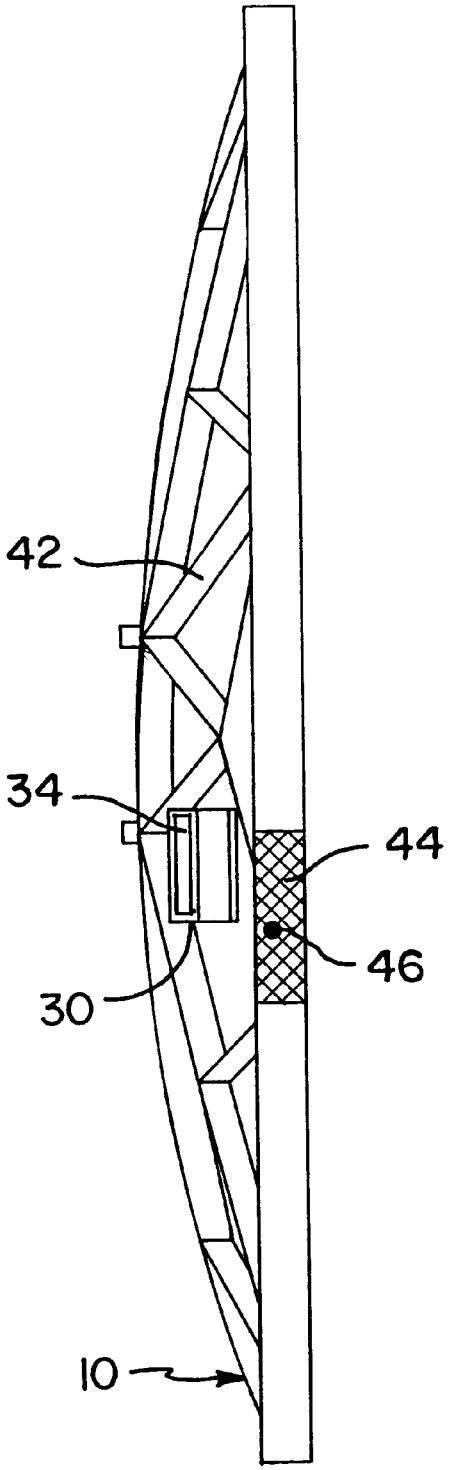
FIG. 2 is a side elevational view of the reflector.
Figure 7:
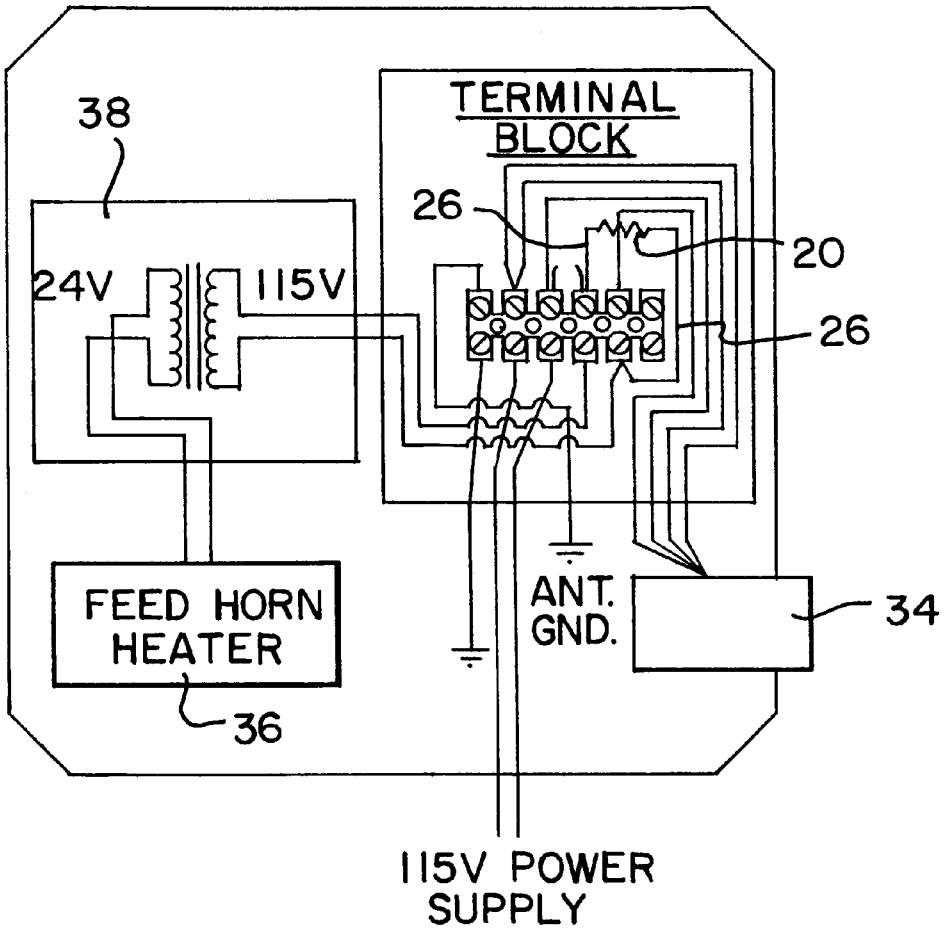
FIG. 7 illustrates a preferred wiring diagram for the heating element.

The junction box preferably includes a switching device for selectively activating heating element 20. The switching device may be of any known construction and is preferably a thermostatic type of switching device. For example, shown in FIGS. 2 and 7 is a temperature/precipitation controller 34 being mounted to junction box 30. The temperature/precipitation controller 34 is connected to heating element 20 through junction box 30. The temperature/precipitation controller 34 monitors climatic conditions, such as the temperature and the amount of precipitation at the surface of the antenna 10, and is configured to energize heating element 20 in dependence upon the climatic conditions. For example, controller 34 may be configured, such that, whenever the temperature reaches a predetermined value, (e.g., between 17 and 39 degrees Fahrenheit), and moisture is present at the surface of antenna 10, controller 34 closes the circuit thereby energizing heating element 20. This selective activation of heating element 20 results in considerable energy savings resulting in lower operating costs.

In certain applications involving a feed horn heater 36, a step-down transformer 38 (FIG. 7) may also be preferably mounted to the back of junction box 30. The step-down transformer 38 reduces the 115/230V power supply to 24V as required to run the horn heater 36.

Also shown in FIG. 1 are four centrally located attachment holes 40 for the antenna support structures (not shown) located on the back side of antenna 10. According to a preferred embodiment of the present invention, the lower two attachment points (40*a* and 40*b*) are used as locator holes in order to properly orient heating element 20 before molding.

FIG. 2 illustrates a side elevational view of antenna 10 shown in FIG. 1. FIG. 2 clearly shows the front concave surface of antenna 10 and its supporting ribs 42. Also shown in FIG. 2 is a hatched area 44 which represents a portion on the outer rim of antenna 10 that has been preferably sprayed with a metalized paint. This metalized area 44 is electrically connected to power supply ground, via junction box 30, and provides a path to ground, giving additional protection against electric shock. A hole 46 is drilled through the rim of antenna 10 within metalized area 44 to secure a grounding conductor.

Referring to FIG. 3, the outline of heating element 20 is shown before it is molded into antenna structure 10. As shown, heating element 20 is adapted to be positioned in the lower half of antenna 10. This arrangement is preferable because, in operation, the front concave reflector surface of antenna 10 is often oriented at an upward-facing angle allowing snow and moisture to accumulate in the lower half of antenna 10. In a preferred embodiment, heating element 20 covers an area having the dimensions described below. These dimensions are only representative and may be modified as appropriate to suit any size antenna 10. For example, heating element 20 is not to be understood to be limited to the lower half of antenna 10, but rather may extend along the entire surface portion of antenna 10, thus heating the entire reflective surface of antenna 10.

In a preferred embodiment as shown in FIG. 3, two locator holes 40*a* and 40*b* are preferably spaced apart from one another on either side of a vertical line Y drawn through the center of heating element 20. As shown in FIG. 4, heating element 20 preferably comprises a fiberglass wrapped resistive heating wire 23, or alternatively an etched aluminum foil 22 (as shown in FIG. 4*a*), which is woven in between a fiberglass mesh screen known as scrim 24. In particular, scrim mesh 24 is formed from a fiberglass material which is compatible with a compression molding process (as will be discussed below). That is, scrim mesh 24 is of sufficient strength to withstand the applied compressive forces resulting from the compression molding process while binding to resin material. The length of each heating coil 22 is chosen in dependence upon its particular application. In particular, the wound heating element 20 is supported in between a single scrim mesh 24*a* (FIG. 6) on the top side of heating element 20 and a double scrim mesh 24*b* (FIG. 6) underneath heating element 20. Preferably, 10 mesh scrim is used which is sufficiently strong to hold heating element 20 in place during the molding process while allowing a sheet molding compound material to follow therethrough, which process typically involves temperatures of 300 degrees Fahrenheit and 1000 psi of pressure.

The two lead wires 26 attached to heating element 20 are of an appropriate gauge of TEFLON insulated wires. Although 8" lead wires are used in this embodiment of the invention, any length of lead wire may be used. The two lead wires 26 are placed approximately 10½" to the right (as viewed in FIG. 3) of the right most locator hole 40*b*. This position preferably corresponds to the location of junction box 30. The lead wires 26 pass into junction box 30 where they are electrically connected to the power supply. According to the invention, the lead wires 26 are placed at a location removed from the supporting ribs 42 of antenna 10. This prevents the lead wires 26 from being pulled into one of the supporting ribs 42 during the molding process. The lead wires 26 of the heating element 20 are preferably covered, (e.g., such as in masking tape) in order to prevent the lead wires 26 from being molded into antenna 10 during the molding process. Upon completion of the molding process, lead wires 26 are pried loose from molded antenna 10.

Figure 6:
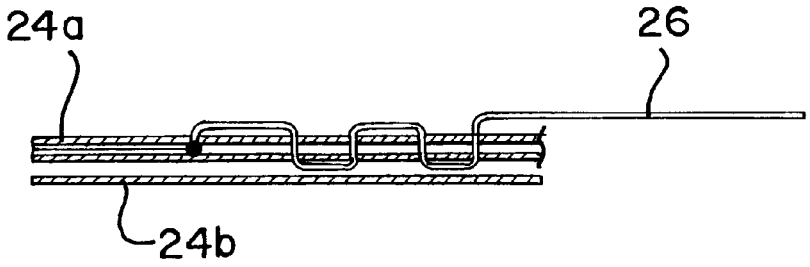

Each lead wire 26 is preferably soldered to the top side of a connecting plate 48 (FIG. 5). Referring to FIGS. 5 and 6, lead wires 26 are preferably laced through the top (24*a*) and bottom (24*b*) layers of the woven scrim mesh 24 to provide stress protection to the connection points of lead wires 26. Also shown in FIG. 6, a scrim patch (not shown) may be placed under each connecting plate 48 to provide additional support.

FIG. 7 is a circuit diagram for a conventional retrofit deicer circuit used to operate heating element 20. As shown, the power is supplied by a 115V power supply which is connected to heating element 20, via the two lead wires 26. Of course the power supply is not to be limited to 115V, but rather may be configured to supply any suitable voltage needed by heating element 20. Further, the power supply also provides power to the temperature/precipitation controller 34. Also shown in FIG. 7 is an optional feed horn heating kit 36 used for removing snow and ice from a feed horn (not shown). The feed horn heating kit 36 provides heat to the entire horn in order to keep ice off the lens and horn cover.

Figure 8:
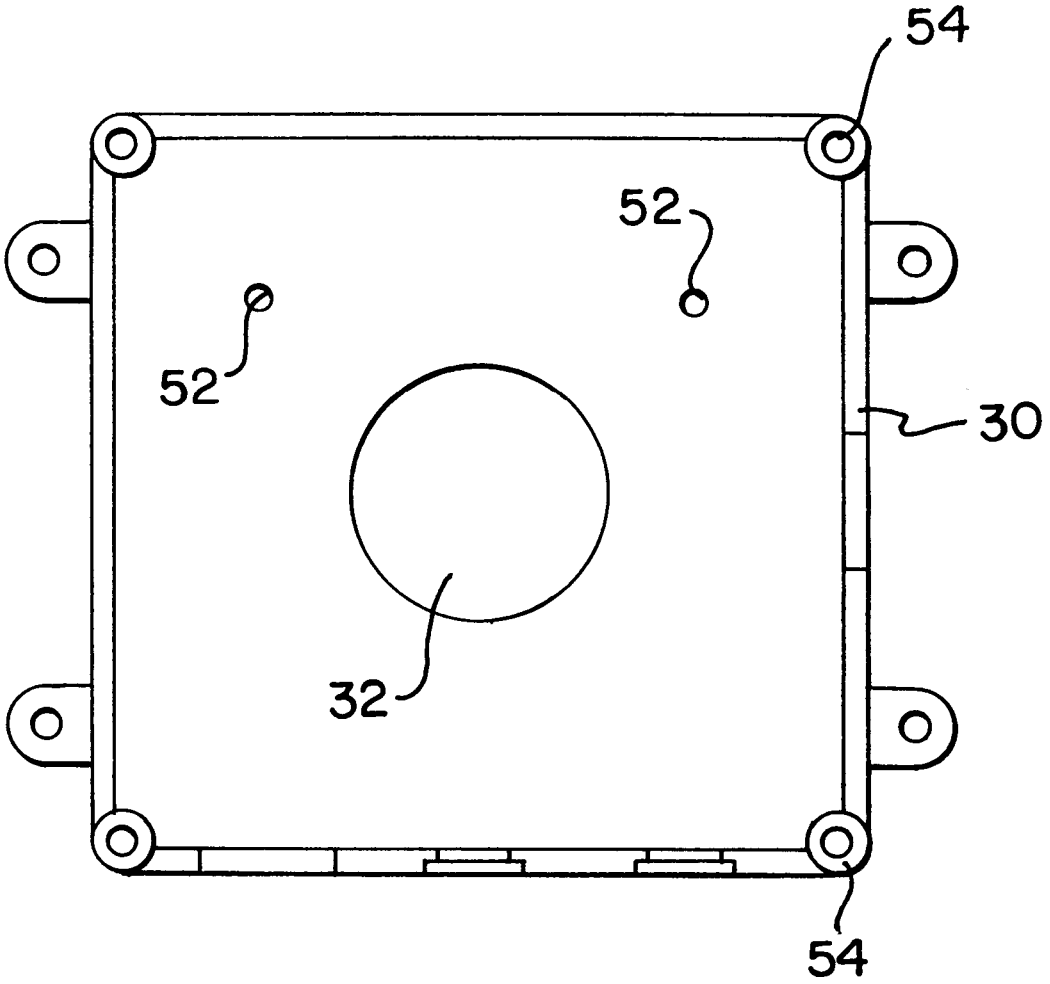
FIG. 8 is a top plan view of the junction box used in conjunction with the invention.

FIG. 8 illustrates the junction box 30 used in conjunction with the invention. Preferably, a 5"×5"×2" PVC junction box is used which is modified to (1) receive lead wires 26 from heating element 20 and (2) attach properly to the back surface of antenna 10. The junction box 30 is adhered directly to the back surface of antenna 10 using any suitable structural adhesive, for example, a two-part epoxy. The two-part epoxy also effectively seals junction box 30, preventing any moisture from entering thereinto. Two holes 52 are located above the central hole 32 in order to mount transformer 38 to junction box 30 when a transformer 38 is employed. At each corner of junction box 30 is a hole 54 for attaching a cover (not shown) to junction box 30.

According to the invention, heating element 20 is molded into the antenna structure 10 using the following process. First, the heating element 20 is supported between the top and bottom layers (24*a* and 24*b*) of the scrim mesh 24. The woven supported heating element 20 is then placed onto the cavity side of the mold (on the bottom side of a sheet molding compound) and lined up so that the holes cut through woven supported heating element 20 correspond to the two locate holes 40*a* and 40*b* of the antenna 10. The sheet molding compound is preferably a polyester resin with fiberglass reinforcements. The two lead wires 26, attached to heating element 20, are placed approximately ¼" to ¾" apart. As disclosed above, lead wires 26 are preferably covered in order to prevent the lead wires 26 from being molded into the completed antenna structure 10. An incision is made in the sheet molding compound to allow lead wires 26 to pass through. This incision is made at a location removed from any of the formed ribs 42 of antenna structure 10. This ensures that lead wires 26 are not positioned underneath a rib 42, which would cause lead wires 26 to be drawn into a rib structure 42 during the molding process. Preferably, lead wires 26 are pulled up through the sheet molding compound and folded back onto the top surface of the sheet. The mold is then closed and antenna 10 is formed using temperatures up to approximately 300 degrees Fahrenheit and approximately between 800–1000 psi of pressure. According to the present invention, heating element 20 is positioned nearer the reflective concave front surface, for example, between 0.005" and 0.025" below the reflective concave surface of antenna 10. This separation provides sufficient insulation to prevent the risk of electrical shock.

Immediately after the sheet molding compound ("SMC") process is complete, and while the compound is still hot, lead wires 26 are pulled out of the sheet molding compound. It is to be appreciated that the process for manufacturing the present invention reflective antenna may utilize a bulk molding compound ("BMC") process or a thick molding compound ("TMC") process instead of the aforementioned SMC process.

Once heating element 20 is within the molded part, the surface of antenna 10 is painted to prepare the reflective surface of antenna 10. In a first embodiment of the invention, a first coating of a polyester enamel paint is injected into the mold and allowed to cure during the molding process. This polyester enamel paint should fully and completely cover the parabolic surface directly over the heating element 20 in order to provide additional dielectric strength. Preferably, the polyester enamel coating spreads to a thickness of approximately 0.004"–0.008". For example, a suitable in-mold coat is Sherwin Williams Polane Glaze IMC FC66 AC 302 (CM #05109), which may be injected and cured during either the SMC, BMC or TMC molding process.

Next, antenna 10 is removed from the mold and allowed to cool. The excess compound caused by seepage between the sides of the mold (flash) is trimmed away from antenna 10. The required holes (FIG. 1) are then drilled into the perimeter of antenna 10. These holes are to attach antenna 10 to its supporting structure.

Next, a metalized conductive paint of, for example, copper or nickel, is sprayed over the concave front surface of antenna 10 and on a portion of the rim 44 as shown in FIG. 2. This metallic coating provides the reflective surface for antenna 10, for reflecting the microwave signals back from the feed horn. According to the invention, the minimum dry film thickness is preferably about 0.002" (two mils) and the reflective loss is preferably less than about 0.1 dB. In the event of a current leakage through the in-mold coat, metalized rim portion 44 carries stray current back to ground. A hole 46 is drilled into metalized rim portion 44 so as to secure to a grounding conductor.

Finally, a top coat is applied over the metalized surface of antenna 10. This top coat preferably has a dry film thickness of at least 0.001 inch. This provides additional protection from the weather.

In an alternative process which does not involve in-mold coating, an epoxy paint or primer is sprayed onto the antenna surface and oven dried at approximately 140–180 degrees Fahrenheit. Multiple layers of the epoxy primer may be applied as required, in order to achieve a thickness and a non-porous quality sufficient to enable antenna 10 to withstand an appropriate dielectric voltage without breakdown; a 50 Hz to 60 Hz essentially sinusoidal RMS test potential equal to 1,000 volts plus two times the system rated voltage.

Further, it is to be appreciated that the above described process for manufacturing a reflective antenna having an integrally molded heating element can be adapted to include a resin transfer molding process ("RTM") and an open molding process (e.g., hand lay-up) by applying a gel coat application to the antenna mold and then placing the heating element within the mold after the gel coat application.

While the invention has been particularly shown and described with reference to a preferred embodiment thereof, it will be understood by those skilled in the art that various changes in form and detail may be made therein without departing from the spirit and scope of the invention.

What is claimed is:

1. A reflective antenna formed by a high-pressure compressive molding process and having a front concave surface and a rear convex surface, said reflective antenna comprising:

a first woven support structure;

a second woven support structure disposed adjacent to said first woven support structure; and a heating element supported between said first and second woven supporting structures, wherein said first and second supporting structures support said heating element in a substantially fixed position during said compressive molding process;

said first and second woven supporting structures being interposed between said front and rear surfaces of said reflective antenna wherein said first woven supporting structure is adjacent to said front surface of said reflective antenna and said second woven supporting structure is adjacent to said rear surface of said reflective antenna;

said heating element including at least one lead wire portion;

said at least one lead wire portion being laced through at least one of said first and second woven supporting structures;

whereby heat generated from said heating element emanates to at least a portion of said front surface of said reflective antenna.

2. A reflective antenna as recited in claim 1, wherein said first and second woven supporting structures are formed from scrim mesh.

3. A reflective antenna as recited in claim 1, wherein said first woven supporting structure is a single scrim mesh.

4. A reflective antenna as recited in claim 3, wherein said second woven supporting structures is a double scrim mesh.

5. A reflective antenna as recited in claim 1, wherein said heating element is an resistive heating wire.

6. A reflective antenna as recited in claim 1, wherein said heating element is a strip of aluminum foil.

7. A reflective antenna as recited in claim 1, wherein said heating element extends at least along a lower half portion of said reflective antenna.

8. A reflective antenna as recited in claim 1, wherein said at least one lead wire portion protrudes from said rear convex surface of said reflective antenna and includes means for electrically connecting said heating element to a power supply.

9. A reflective antenna as recited in claim 8, further including a controller coupled to said at least one lead wire portion and to said power supply, said controller being adapted to activate said heating element in dependence upon climatic conditions by connecting said power supply to said at least one lead wire portion.

10. A reflective antenna as recited in claim 1, wherein said front surface of said reflective antenna has a dielectric substrate layer.

11. A reflective antenna as recited in claim 10, wherein said front surface of said antenna has a reflective metallic layer disposed atop said dielectric substrate layer.

12. A reflective antenna assembly comprising:

an antenna dish having a front concave surface and a rear convex surface; and an electrical heater molded between said front concave surface and rear convex surface of said antenna dish, said electrical heater being supported by a mesh supporting material and having at least one lead wire portion laced through said mesh supporting material, whereby heat generated from said electrical heater emanates to at least a portion of said front concave surface of said antenna dish.

13. A reflective antenna assembly as recited in claim 12, wherein said mesh supporting material is formed of a material sufficient to withstand the compressive forces resulting from a compression molding technique.

14. A reflective antenna assembly as recited in claim 12, wherein said electrical heater is an resistive heating element positioned at a shorter distance from said concave front surface relative to said rear convex surface of said antenna dish.

15. A reflective antenna assembly as recited in claim 14, wherein said mesh supporting material includes a single scrim mesh adjacent to said front concave surface of said antenna dish and a double scrim mesh adjacent to said rear convex surface of said antenna dish, whereby said resistive heating element is retained between said single and double scrim mesh.

16. A reflective antenna assembly as recited in claim 14, wherein said at least one lead wire portion extends from said rear convex surface of said antenna dish and includes means for connecting said heating element to a power supply.

17. A reflective antenna assembly as recited in claim 16, further including a controller coupled to said at least one lead wire portion and to said power supply, said controller being configured to activate said resistive heating element by connecting said at least one lead wire portion to said power supply in dependence upon climatic conditions.

18. A reflective antenna assembly as recited in claim 12, wherein said antenna dish has a metallic outer rim portion electrically connected to power supply ground, whereby said metallic outer rim portion provides an electrical path from said electrical heater to ground.

19. A process for manufacturing a heatable reflective antenna having a front concave surface and a rear convex surface, said process including the steps of:

placing an electrical heating element having at least one lead wire portion in a layer of woven material to form a layer of woven material having a retained electrical heating element;

lacing said at least one lead wire portion through said woven material;

embedding said layer of woven material and retained electrical heating element in a curable compound;

curing said compound to form said heatable reflective antenna; and extending said at least one lead wire portion from said rear convex surface of said cured reflective antenna after said curing step.

20. A process as recited in claim 19, further including the step of:

applying a layer of dielectric material on at least said front concave surface of said cured reflective antenna.

21. A process as recited in claim 20, further including the step of:

applying a reflective metallic layer atop said layer of dielectric material on said front concave surface of said cured reflective antenna.

22. A reflective antenna assembly comprising:

an antenna dish having a front concave surface, a rear convex surface, and a metallic outer rim portion; and an electrical heater molded between said front concave surface and rear convex surface of said antenna dish, said electrical heater being woven in a mesh supporting material, whereby heat generated from said electrical heater emanates to at least a portion of said front concave surface of said antenna dish; wherein said metallic outer rim portion is electrically connected to power supply ground to thereby provide an electrical path from said electrical heater to ground.

23. A reflective antenna assembly comprising:

an antenna dish having a front concave surface, a rear convex surface, and a metallic outer rim portion; and an electrical heater molded between and electrically insulated from said front concave surface and rear convex surface of said antenna dish, said electrical heater being woven in a mesh supporting material, whereby heat generated from said electrical heater emanates to at least a portion of said front concave surface of said antenna dish; wherein said metallic outer rim portion is electrically connected to power supply ground to thereby provide a potential electrical path from said electrical heater to ground in the event of an electrical short between said electrical heater and said antenna.

* * * * *